US010779599B2

(12) United States Patent
Votel et al.

(10) Patent No.: US 10,779,599 B2
(45) Date of Patent: Sep. 22, 2020

(54) BUMP CAP

(71) Applicant: Tenacious Holdings, Inc., St. Paul, MN (US)

(72) Inventors: Thomas Votel, Sunfish Lake, MN (US); Andrew Olson, Minneapolis, MN (US); Jeffrey Popowski, Roseville, MN (US); Gregory Schrab, Shoreview, MN (US)

(73) Assignee: Tenacious Holdings, Inc., St. Paul, MN (US)

( * ) Notice: Subject to any disclaimer, the term of this patent is extended or adjusted under 35 U.S.C. 154(b) by 125 days.

(21) Appl. No.: 15/810,133

(22) Filed: Nov. 12, 2017

(65) Prior Publication Data

US 2019/0090573 A1 Mar. 28, 2019

Related U.S. Application Data

(63) Continuation-in-part of application No. 29/619,071, filed on Sep. 26, 2017, now Pat. No. Des. 867,672.

(51) Int. Cl.

| | |
|---|---|
| ***A42B 3/12*** | (2006.01) |
| ***A42B 3/06*** | (2006.01) |
| ***A42B 1/08*** | (2006.01) |
| *A42B 1/04* | (2006.01) |

(52) U.S. Cl.
CPC . *A42B 3/06* (2013.01); *A42B 1/08* (2013.01)

(58) Field of Classification Search
CPC .. A42B 3/127; A42B 1/08; A42B 3/12; A42B 3/125; A42B 3/121; A42B 3/00; A42B 3/06; A42B 3/10; A42B 3/28; A42B 3/322; A42B 3/128; A42B 3/32; A42B 3/04; A42B 1/069; A42B 1/201; A42B 3/0406; A42B 3/283
See application file for complete search history.

(56) References Cited

U.S. PATENT DOCUMENTS 1,602,727 A * 10/1926 Turner ..... A42B 3/127 2/414
2,420,522 A * 5/1947 Grand ..... A42B 3/06 114/357
2,753,561 A * 7/1956 Mauro ..... A42B 1/08 2/423
2,969,547 A * 1/1961 Dye ..... A42B 1/08 2/411
3,153,792 A * 10/1964 Marietta ..... A42B 3/127 2/414
3,208,080 A * 9/1965 Hirsch ..... A42B 3/322 2/414

(Continued)

FOREIGN PATENT DOCUMENTS

WO 2017006078 A1 1/2017

OTHER PUBLICATIONS

Search Report and Written Opinion for PCT/US2018/046404, dated Oct. 16, 2018, 9 pages.

*Primary Examiner* — Robert H Muromoto, Jr.
(74) *Attorney, Agent, or Firm* — Skaar Ulbrich Macari, P.A.

(57) ABSTRACT

The presented invention is an adjustable protective Bump Cap to be worn under a hat. The Bump Cap has adjustable horizontal and vertical dimensions to enable a secure fit and to remain out of sight when worn under a user's hat.

6 Claims, 7 Drawing Sheets

(56) References Cited

U.S. PATENT DOCUMENTS 3,500,473 A * 3/1970 Marchello ..... A42B 3/065 2/414
3,529,306 A * 9/1970 Thorne ..... A41D 31/02 2/411
3,568,210 A * 3/1971 Marietta ..... A42B 3/125 2/413
3,577,562 A * 5/1971 Holt ..... A42B 3/10 2/414
3,609,764 A * 10/1971 Morgan ..... A42B 3/122 2/414
3,897,596 A * 8/1975 Aileo ..... A42B 3/14 2/420
3,994,020 A * 11/1976 Villari ..... A42B 3/122 2/413
D267,287 S * 12/1982 Gooding ..... D29/122
4,375,108 A * 3/1983 Gooding ..... A42B 3/121 2/413
4,432,099 A * 2/1984 Grick ..... A42B 3/124 2/412
4,484,364 A * 11/1984 Mitchell ..... A42B 3/124 2/413
4,596,056 A * 6/1986 Grick ..... A42B 3/063 2/2.5
4,627,114 A * 12/1986 Mitchell ..... A42B 3/128 2/414
4,996,724 A * 3/1991 Dextrase ..... A42B 3/066 2/411
5,012,533 A * 5/1991 Raffler ..... A42B 3/066 2/420
5,035,009 A * 7/1991 Wingo, Jr. ..... A42B 3/121 2/414
5,119,505 A * 6/1992 Tisseront ..... A42B 3/30 455/350
5,173,970 A * 12/1992 Shifrin ..... A42B 1/08 2/209.12
5,177,815 A * 1/1993 Andujar ..... A42B 3/00 2/411
5,271,103 A * 12/1993 Darnell ..... A42B 1/08 2/411
5,289,591 A * 3/1994 Andersen ..... A42B 1/08 2/195.5
5,337,420 A * 8/1994 Haysom ..... A42B 3/14 2/181
D364,496 S * 11/1995 Lejuez ..... D2/892
5,515,546 A * 5/1996 Shifrin ..... A42B 3/00 2/209.11
5,661,854 A * 9/1997 March, II ..... A42B 3/00 2/410
5,913,412 A * 6/1999 Huber ..... A42B 3/28 2/413
6,073,271 A * 6/2000 Alexander ..... A42B 3/122 2/413
6,093,468 A * 7/2000 Toms ..... A41D 13/0158 428/67
6,240,571 B1 * 6/2001 Infusino ..... A42B 3/127 2/414
6,381,759 B1 * 5/2002 Katz ..... A42B 3/00 2/410
6,385,780 B1 * 5/2002 Racine ..... A42B 3/12 2/414
6,434,755 B1 * 8/2002 Halstead ..... A42B 3/06 2/413
6,647,556 B2 * 11/2003 Grepper ..... A42B 3/324 2/410
6,694,529 B1 * 2/2004 Chiu ..... A42B 3/12 2/411
6,751,808 B2 * 6/2004 Puchalski ..... A42B 3/324 2/411
6,883,181 B2 * 4/2005 Long ..... A42B 3/127 2/414
6,996,856 B2 * 2/2006 Puchalski ..... A42B 3/064 2/411
7,010,814 B2 * 3/2006 Benziger ..... A42B 1/08 2/171.2
7,159,249 B2 * 1/2007 Dennis ..... A42B 3/08 2/414
D577,866 S * 9/2008 Frye ..... D29/122
D612,545 S * 3/2010 Pliszka ..... D29/122
7,673,350 B2 * 3/2010 Mazzoccoli ..... A42B 1/08 2/411
D617,503 S * 6/2010 Szalkowski ..... D29/122
8,001,622 B1 * 8/2011 Culley ..... A42B 3/127 2/267
8,196,226 B1 * 6/2012 Schuh ..... A42B 3/046 2/410
D671,271 S * 11/2012 Votel ..... D29/102
D687,215 S * 8/2013 Padgett ..... D2/891
8,640,267 B1 * 2/2014 Cohen ..... A42B 3/063 2/411
8,739,316 B1 * 6/2014 Norton ..... A42B 1/08 2/411
8,789,212 B2 * 7/2014 Cleva ..... A42B 3/04 2/171
9,364,039 B2 * 6/2016 Pusateri ..... A42B 1/069
D784,627 S * 4/2017 Williams ..... D29/122
D784,628 S * 4/2017 Fleming ..... D29/122
D812,313 S * 3/2018 Williams ..... D29/122
10,149,511 B2 * 12/2018 Vito ..... A42B 3/125
10,285,466 B2 * 5/2019 Princip ..... A42B 3/20
2002/0002730 A1 * 1/2002 Dennis ..... A42B 3/12 2/411
2002/0023290 A1 * 2/2002 Watters ..... A42B 3/08 2/410
2002/0152542 A1 * 10/2002 Dennis ..... A42B 3/12 2/414
2004/0034903 A1 * 2/2004 Blair ..... A42B 1/08 2/411
2004/0107482 A1 * 6/2004 Picotte ..... A42B 1/08 2/411
2004/0226077 A1 * 11/2004 Toth ..... A42B 3/10 2/411
2005/0251899 A1 * 11/2005 Dennis ..... A42B 3/12 2/414
2005/0268383 A1 * 12/2005 Harris ..... A42B 3/121 2/413
2006/0096011 A1 * 5/2006 Dennis ..... A42B 3/08 2/414
2006/0168712 A1 * 8/2006 Mazzoccoli ..... A42B 1/08 2/411
2006/0260026 A1 * 11/2006 Doria ..... A42B 3/127 2/414
2006/0260105 A1 * 11/2006 Votel ..... A45F 5/004 24/545
2007/0130673 A1 * 6/2007 Wasserkrug ..... A42B 1/08 2/411
2007/0157370 A1 * 7/2007 Joubert Des Ouches ..... A42B 3/06 2/410
2007/0163031 A1 * 7/2007 Lewis, Jr. ..... A42B 3/127 2/414
2009/0158506 A1 * 6/2009 Thompson ..... A42B 3/127 2/411
2010/0306904 A1 * 12/2010 Neid ..... A42B 1/08 2/414
2011/0302700 A1 * 12/2011 Vito ..... A42B 3/14 2/412
2011/0307997 A1 * 12/2011 Blair ..... A42B 1/08 2/414
2012/0036620 A1 * 2/2012 Harris ..... A42B 3/127 2/414
2012/0260392 A1 * 10/2012 Votel ..... A41D 13/065 2/24
2012/0317705 A1 * 12/2012 Lindsay ..... A42B 3/062 2/413
2013/0000017 A1 * 1/2013 Szalkowski ..... A42B 3/127 2/414
2013/0340146 A1 * 12/2013 Dekker ..... A42B 3/125 2/411

(56) References Cited

U.S. PATENT DOCUMENTS

| | | | | |
|---|---|---|---|---|
| 2014/0007325 | A1* | 1/2014 | Davis | A42B 3/127 2/413 |
| 2014/0020158 | A1* | 1/2014 | Parsons | A42B 3/122 2/413 |
| 2014/0082810 | A1* | 3/2014 | Daniels | A61F 9/067 2/8.2 |
| 2014/0223644 | A1* | 8/2014 | Bologna | A42B 3/20 2/414 |
| 2014/0259318 | A1* | 9/2014 | Daniels | A42B 3/225 2/424 |
| 2014/0325745 | A1* | 11/2014 | Erb | A42B 3/127 2/414 |
| 2015/0089726 | A1* | 4/2015 | Long | A42B 3/003 2/422 |
| 2015/0264993 | A1* | 9/2015 | Vito | A42B 3/125 2/414 |
| 2015/0305430 | A1* | 10/2015 | Rush | A42B 3/124 2/412 |
| 2016/0255897 | A1* | 9/2016 | Johnson | A42B 3/127 |
| 2017/0105461 | A1 | 4/2017 | Hancock et al. | |
| 2018/0140037 | A1* | 5/2018 | Frieder, Jr. | B32B 27/065 |
| 2019/0090568 | A1* | 3/2019 | Votel | A42B 1/08 |

* cited by examiner

BUMP CAP

CLAIM OF BENEFIT TO PRIOR APPLICATIONS

This application is a continuation-in-part of U.S. Design Application No. 29/619,071 filed Sep. 26, 2017; and such application is hereby fully incorporated by reference herein.

FIELD

The present invention relates generally to protective headwear. More particularly, the present invention relates to an adjustable Bump Cap.

BACKGROUND

Bump Caps are useful for protecting the wearer's head from bumps, cuts and bruises as a result of contact with objects such as overhead pipes, low ceilings and other objects. They are most often worn under a personal hat, uniform cap, baseball hat or other non-protective headwear.

There are many different types of non-protective headwear, such as the so-called trucker's hat, which tends to be of a taller dimension, and a variety of baseball type hats that can be structured, unstructured, low profile and higher profile. There are also a variety of other personal hats, such as Trilby, Fedora, bucket, cowboy and stocking hats. Because of the variable dimensions of these hats there is a current and unfulfilled need for a Bump Cap that can be adjusted to accommodate the various hat dimensions.

SUMMARY

The invention provides a Bump Cap to be worn under a variety of hats that can be flexible to allow for horizontal variations in hat dimensions, and trimable to allow for variation in the vertical variations in hat dimensions.

This summary is not intended to limit the scope of the invention, or describe each embodiment, implementation, feature or advantage of the invention.

DESCRIPTION OF THE PREFERRED EMBODIMENTS

It will be apparent to those skilled in the art, that is, to those who have knowledge or experience in this area of technology, which many uses and design variations are possible for the adjustable Bump Cap disclosed herein. The following detailed discussion of the preferred embodiment will illustrate the general principles of the invention with reference to the disclosed Bump Cap. Other embodiments suitable for other applications will be apparent to those skilled in the art given the benefit of this disclosure.

The Bump Cap is preferably injection molded from a thermoplastic polymer such as polypropylene. Those skilled in the art will recognize that other rigid materials that have at least some flexibility may also be used.

Figure 1:
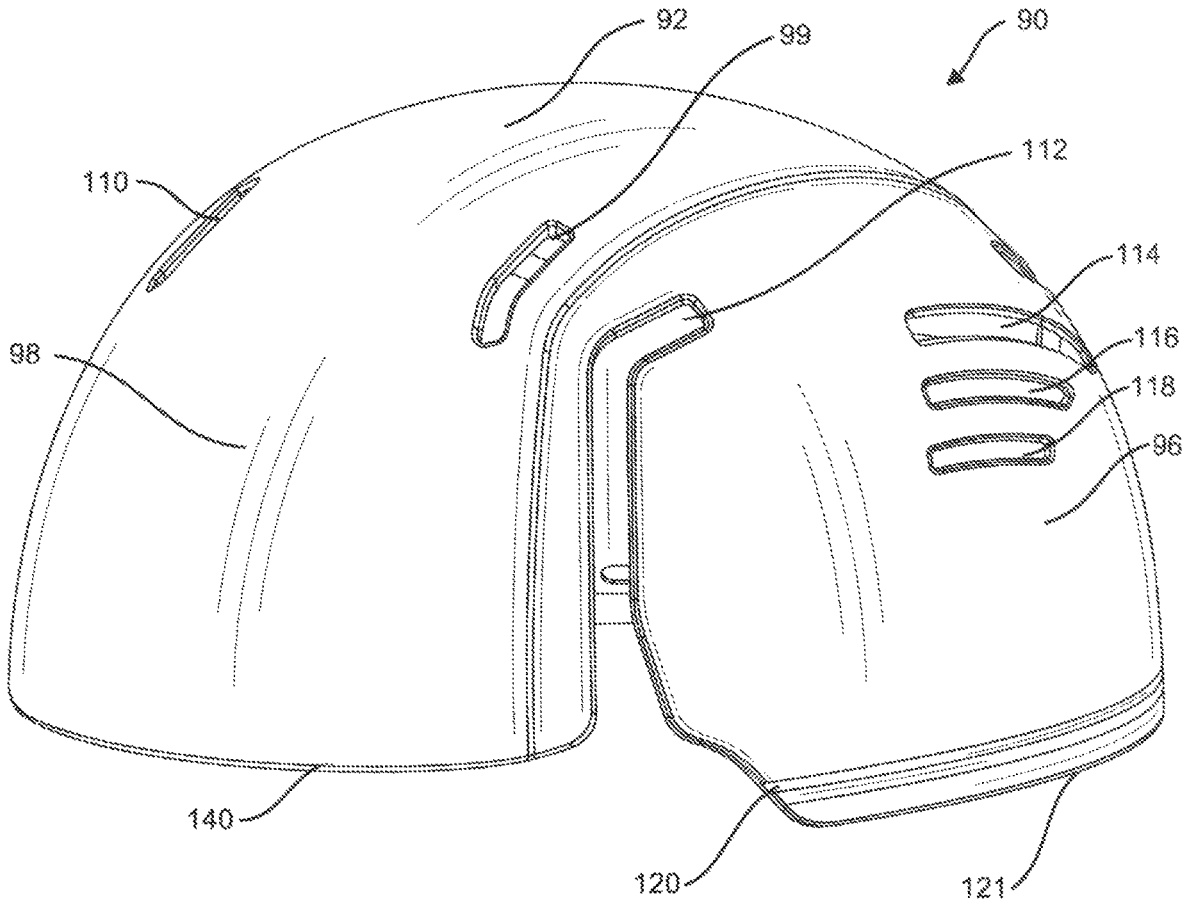
FIG. 1 is a front perspective view of a preferred embodiment of the invention.
Figure 2:
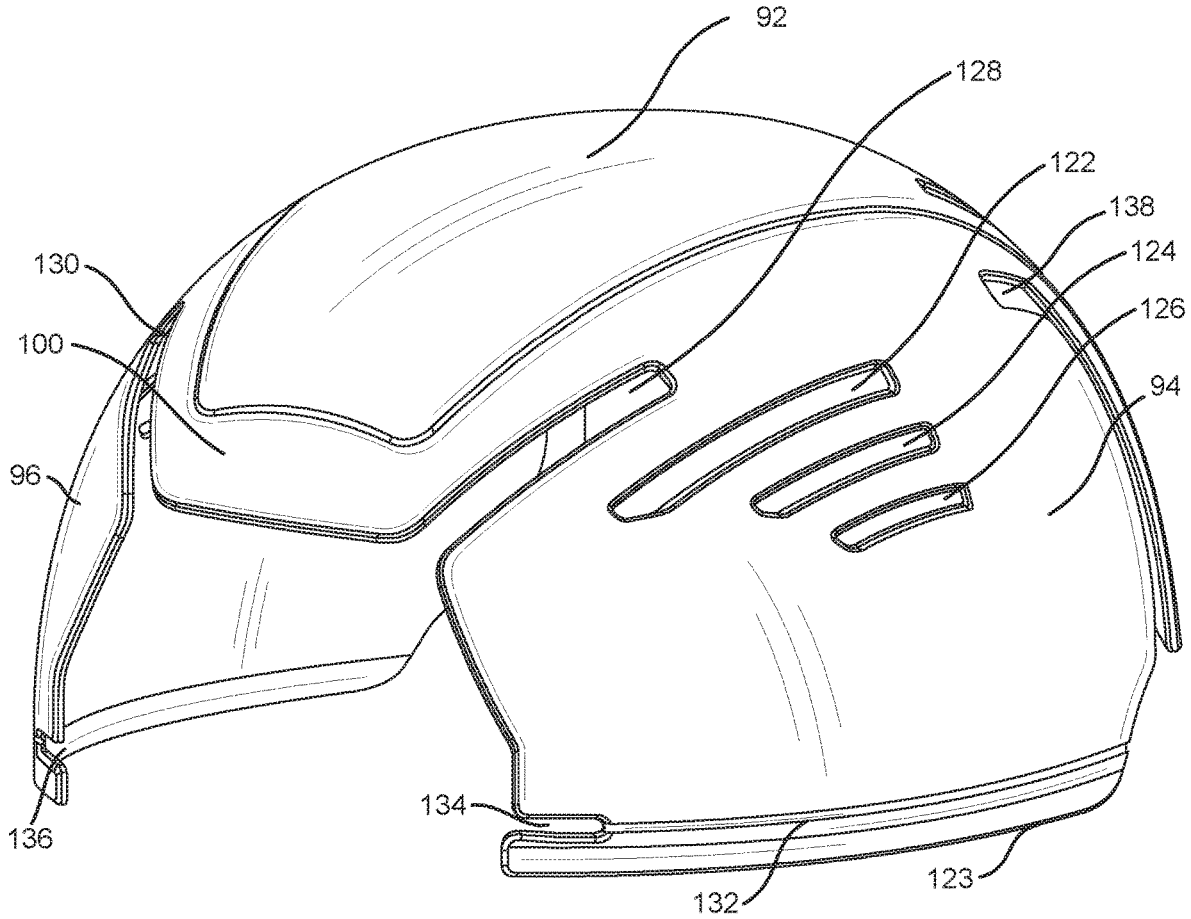
FIG. 2 is a rear perspective view of a preferred embodiment of the invention.
Figure 3:
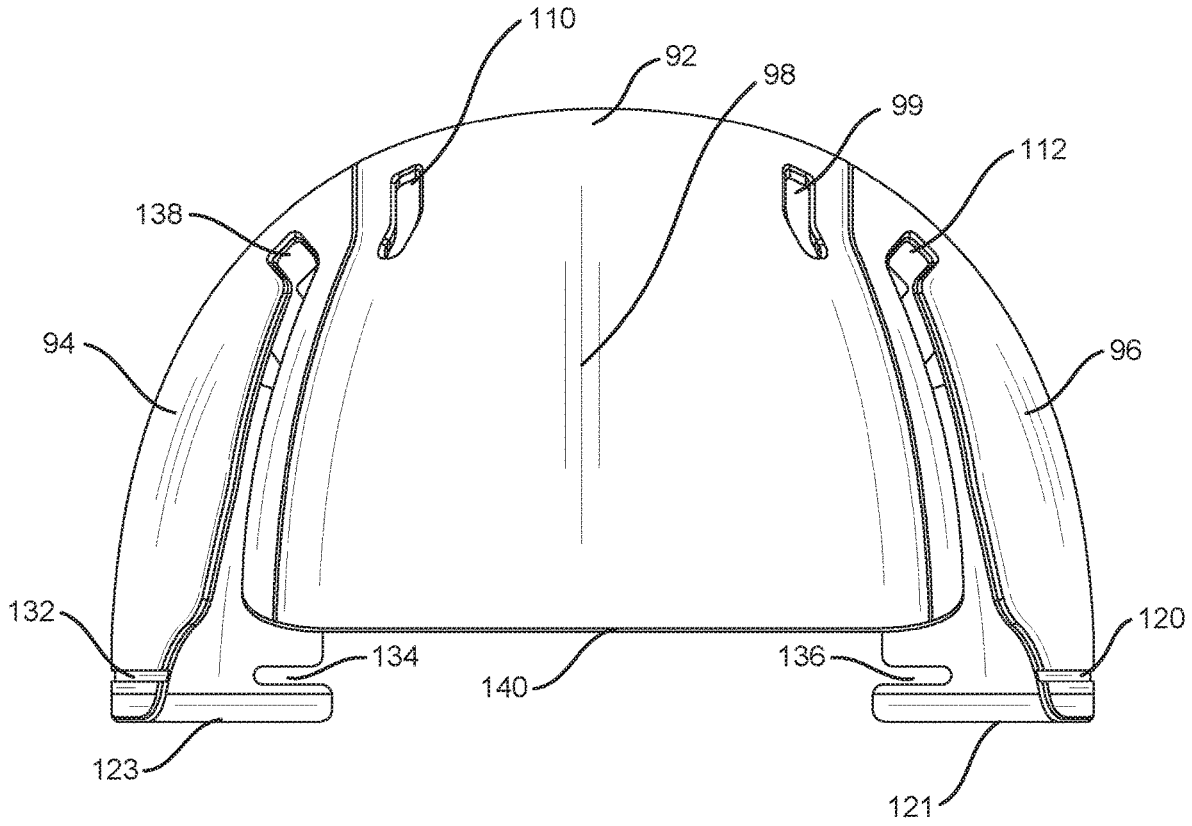
FIG. 3 is a front elevation of a preferred embodiment of the invention.
Figure 4:
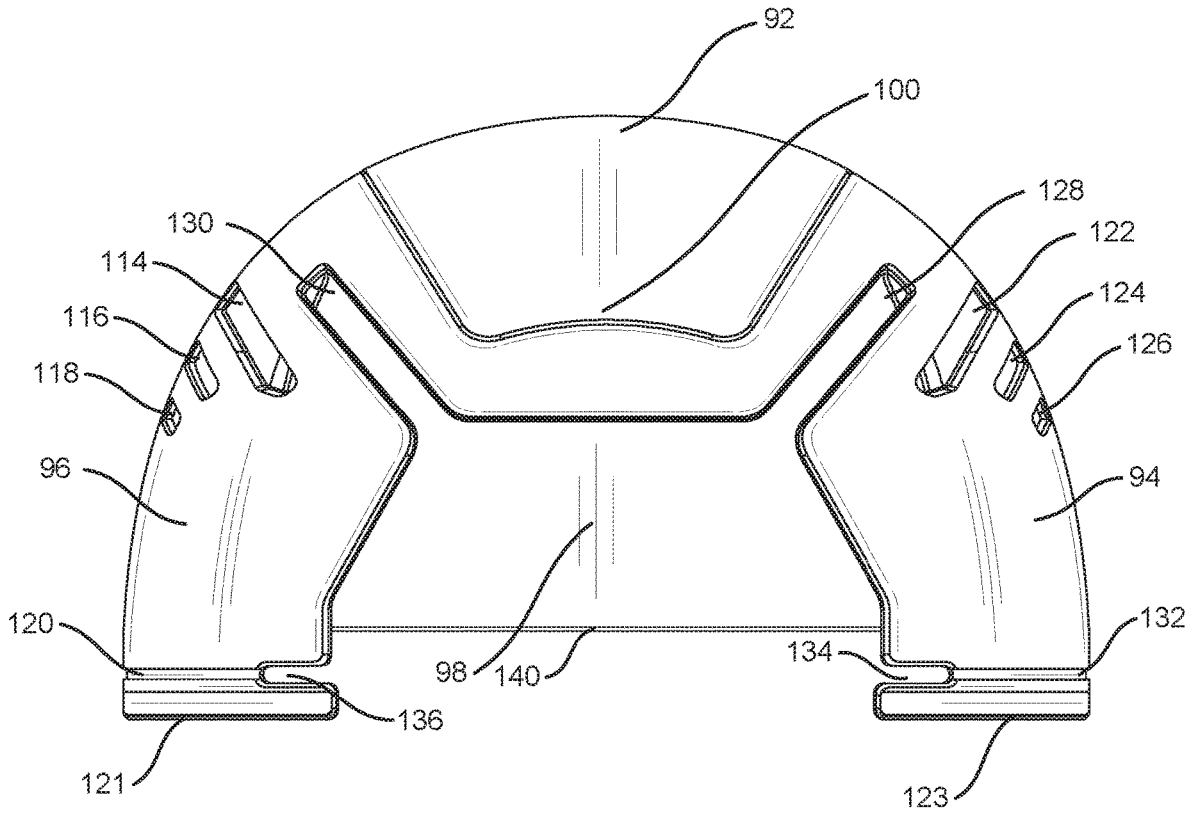
FIG. 4 is a rear elevation of a preferred embodiment of the invention.
Figure 5:
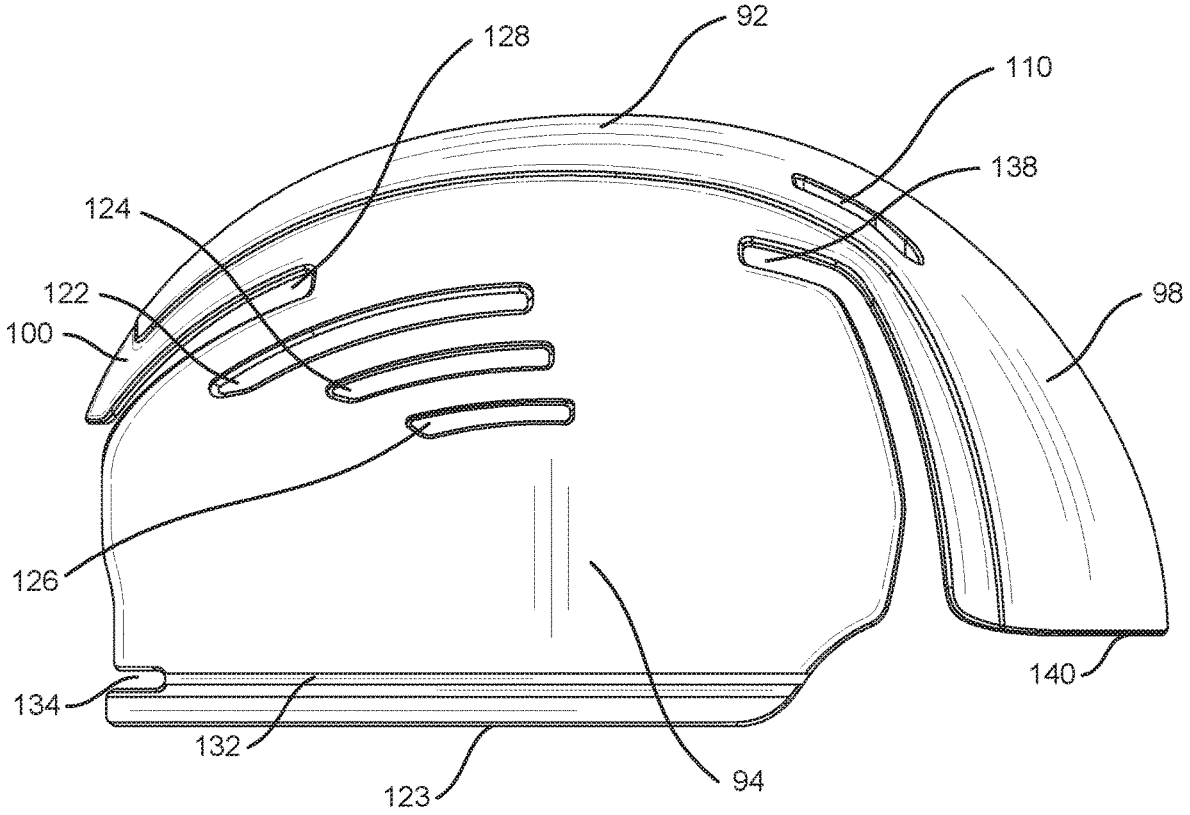
FIG. 5 is right side elevation view of a preferred embodiment of the invention.
Figure 6:
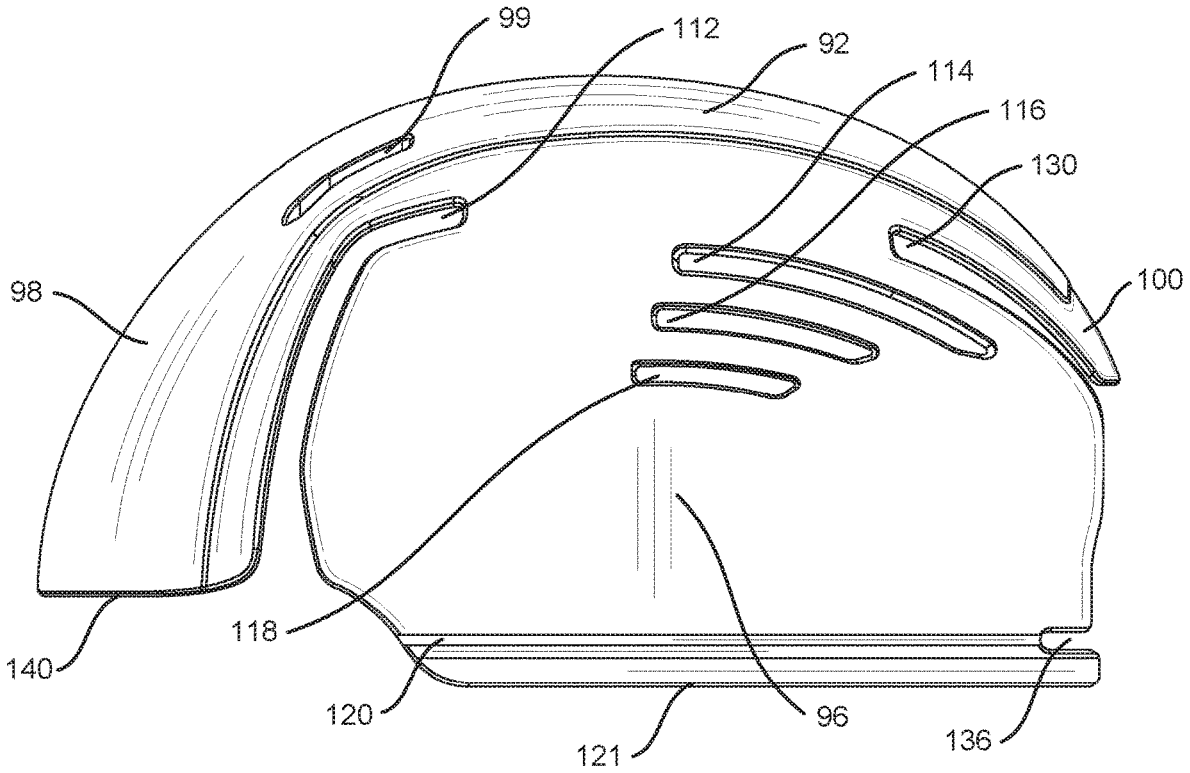
FIG. 6 is a left side elevation view of a preferred embodiment of the invention.
Figure 7:
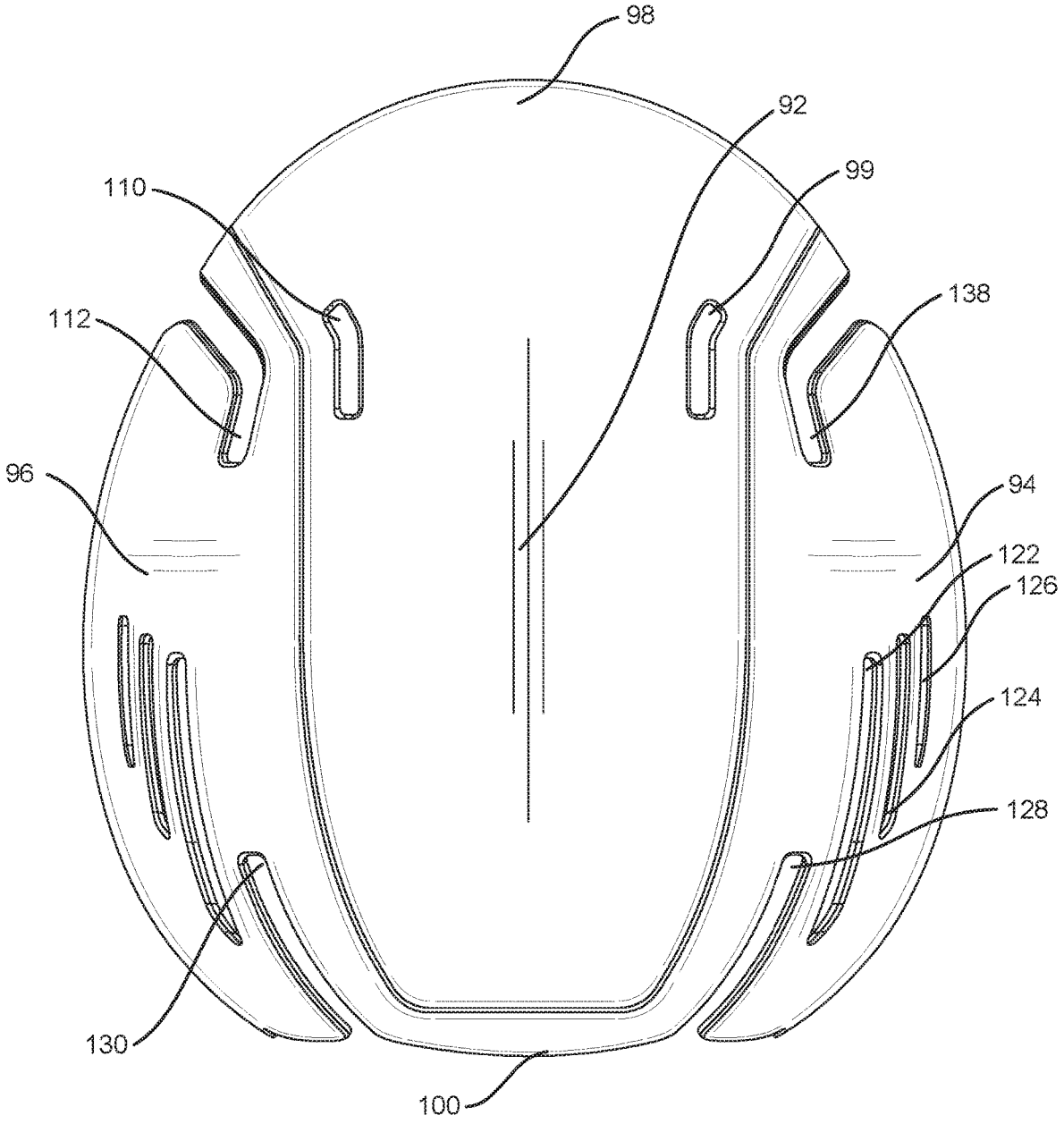
FIG. 7 is a top plan view of a preferred embodiment of the invention.

With reference to FIGS. 1-7, the various features of Bump Cap 90 are shown. Bump Cap 90 is comprised of crown 92 right side portion 94, left side portion 96, visor portion 98 and rear flap portion 100. Vents 114, 116 and 118 provide left side portion 96 ventilation, whereas vents 122, 124 and 126 provide right side portion 94 ventilation. Vents 110 and 99 provide crown 92 ventilation. One skilled in the art will understand that more or fewer vents may be required, and placement may be varied, according to environmental conditions or users' requirements.

Flex joints 138, 112, 128 and 130 allow Bump Cap 90 to flex when inserted into a hat to allow for variations in the hat's horizontal dimensions and to aide it securing Bump Cap 90 in place. Flex joints 138, 112, 128 and 130 also may supply additional ventilation.

Trim grooves 120 and 132 are located on the lower perimeter 121 of left side portion 96 and lower perimeter 123 on right side portion 94. Trim groove 120 runs horizontally along lower perimeter 121 on the left side portion 96. Trim groove 132 runs horizontally along lower perimeter 123 on right side portion 94. Trim grooves 120 and 132 allow sections of Bump Cap 90 to be removed by hand, box knife, scissors or other means. Removal of sections of Bump Cap 90 via trim grooves 120 and 132 allow the vertical dimensions of Bump Cap 90 to be adjusted so as to remain secure and hidden under a user's hat. One skilled in the art will appreciate that more than one trim groove may be incorporated into Bump Cap 90 to allow for greater vertical dimension adjustment.

Trim notches 134 and 136 assist the user in removing a portion of Bump Cap 90 at the trim groves 120 and 132. More trim notches may be used to accommodate a greater number of trim grooves. Trim grooves and respective trim notches may also be incorporated into leading edge 140 of visor portion 98 to allow for the vertical adjustment of visor portion 98 (grooves not shown).

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A Bump Cap to be worn under a hat comprising:

a rigid skull shaped shell having a right side portion, a left side portion, a crown portion, a visor portion and a rear flap portion;

a vent located in the right side portion;

a vent located in the left side portion;

a vent located in the crown portion;

a flexible joint located between the visor portion and the left side portion;

a flexible joint located between the visor portion and the right side portion;

a flexible joint located between the right side portion and the rear flap portion;

a flexible joint located between the left side portion and the rear flap portion;

a horizontal trim groove, to allow for removal of a portion of the shell, located on a lower perimeter of the left side portion; and, a horizontal trim groove, to allow for removal of a portion of the shell, located on a lower perimeter of the right side portion.

2. The Bump Cap of claim 1 wherein the vents located in the left and right side portions are elongated and configured horizontally.

3. The Bump Cap of claim 1 wherein the trim grooves have adjacent trim notches.

4. A Bump Cap to be worn under a hat comprising:

a rigid shell having a visor portion, a crown portion, a left side portion and a right side portion;

a flexible joint located between the visor portion and the right side portion;

a flexible joint located between the visor portion and the left side portion;

a horizontal trim groove located on the left side portion;

a horizontal trim groove located on the right side portion; and, whereas a vertical dimension of the shell maybe adjusted by removing a portion of the shell at the right or left side portion trim groove.

5. The bump cap of claim 4 wherein a vent is located on the crown portion.

6. The bump cap of claim 4 wherein each horizontal trim grove has an adjacent trim notch.

* * * * *